US006775492B2

(12) United States Patent
Miyakoshi et al.

(10) Patent No.: US 6,775,492 B2
(45) Date of Patent: Aug. 10, 2004

(54) FLASH FIXATION APPARATUS WITH GAS UNIT AND PRINTER USING THE SAME

(75) Inventors: Kunio Miyakoshi, Kawasaki (JP); Osamu Shimizu, Kawasaki (JP); Akio Itabashi, Kawasaki (JP); Shinji Ohshima, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/285,442

(22) Filed: Nov. 1, 2002

(65) Prior Publication Data

US 2003/0147666 A1 Aug. 7, 2003

(30) Foreign Application Priority Data

Feb. 7, 2002 (JP) ..... 2002-031086

(51) Int. Cl.[7] ..... G03G 21/20
(52) U.S. Cl. ..... 399/92; 399/93
(58) Field of Search ..... 399/92, 93, 336

(56) References Cited

U.S. PATENT DOCUMENTS 3,492,458 A * 1/1970 White et al. ..... 399/336 X
4,248,520 A * 2/1981 Kurita et al. ..... 399/92
4,415,533 A * 11/1983 Kurotori et al. ..... 399/93 X
5,021,831 A * 6/1991 Tonomoto ..... 399/93

FOREIGN PATENT DOCUMENTS

| | | |
|---|---|---|
| JP | 63-89883 | 4/1988 |
| JP | 9-34199 | 2/1997 |
| JP | 11-138752 | 5/1999 |
| JP | 2000-118825 | 4/2000 |
| JP | 2001-26352 | 1/2001 |

* cited by examiner

*Primary Examiner*—William J. Royer
(74) *Attorney, Agent, or Firm*—Westerman, Hattori Daniels & Adrian, LLP

(57) ABSTRACT

A flash fixing apparatus effectively collect vapor gas produced at the time of fixation while fixing a toner image of medium by means off flashlight. In the flash fixation unit, vapor gas produced in flash fixation flows toward the medium transportation direction. Utilizing this phenomenon, a gas suction face is provided in a gas collector so as to receive the vapor gas flowing toward the medium transportation direction. Otherwise, a gas blast portion is provided at the rear stage of the gas collector. The vapor gas flows to the gas suction face naturally, bringing about improved gas collection efficiency.

16 Claims, 10 Drawing Sheets

FLASH FIXATION APPARATUS WITH GAS UNIT AND PRINTER USING THE SAME

BACKGROUND OF THE INVENTION

1. Field of the Invention

The present invention relates to a flash fixation apparatus for fixing toners on a medium by means of flash light and a printer using the same, and more particularly a flash fixation apparatus for collecting gas produced from the toners during flash fixation and a printer using the same.

2. Description of the Related Art

In a printer for forming toner images in which the electrophotographic scheme of the like is employed, an image is formed by means of a powder toner on a print medium. The toner image is then fixed by fusing the powder toner placed on the print medium. To fix the toner image, it is necessary to apply fixation energy onto the print medium.

In a high-speed printer, a non-contact type fixation method is employed as a fixation method for applying the fixation energy. It is suitable to use the non-contact type fixation method in the high-speed printer because high fixation energy can be applied without influencing transportation of the print medium.

As one method of this non-contact type fixation method, a flash fixation method employing flash light produced by a flash lamp. In the flash fixation method, light is emitted from the flash lamp at predetermined intervals corresponding to the transportation of the print medium to fix on each predetermined area of the print medium.

FIG. 18 shows a configuration diagram of the conventional flash fixation unit. In a flash fixation unit 13, a flash lamp 101 and a reflection plate 102 are accommodated in a lamp house 100. The lamp house 100 on the paper 110 side is covered with a glass plate 103 to isolate the internal portion of the lamp house 100 from outside.

A toner image 114 is formed on the paper 110 guided by a pair of carrying rollers 112 and 116. The paper 110 is carried continuously while maintaining a position opposite to the glass plate 103 and is received the flashlight emitted from the flash lamp 101. The toner 114 on the paper 110 is abruptly heated by the energy applied from the flashlight, producing gas (evaporated gas) C from the toner 114.

Gas C adheres onto the flash lamp 101, the glass plate 103 for protecting the lamp 101, the print paper 110, the carrying roller 116 outside the fixation unit, etc. If the gas having adhered is not removed, the gas may cause a failure, such as a decreased fixation ratio, degraded print quality and malfunction of medium transportation.

Conventionally, in order to circumvent this problem, there has been provided a suction mechanism (or degassing mechanism) 104 on the rear side of the flash fixation unit for collecting the gas (evaporated gas) C to suck and deodorize. This mechanism enables to prevent gas adhesion to the lamp house 100, the paper 110 and the carrying roller 116, by which smell diffusion can also be prevented.

However, as print speed of a printer becomes higher in recent years, transportation speed of the paper 110 becomes higher and, at the same time, higher fixation speed is required. This has required an increased amount of gas generation produced from the toner 114 on the paper 110, resulting in a tendency of gas leakage in the downstream side of the flash fixation unit, that is the transportation direction of the paper 110, as shown by arrow B.

To prevent the gas leakage in the conventional art, it is normally necessary to increase either suction power or suction area so that the produced gas can be sufficiently sucked by suction mechanism 104, as shown in FIG. 19, and gas collection efficiency can be increased.

However, when increasing the suction power, pressure to float up out of the transportation plane is produced on the paper 110, caused by the gas (evaporated gas) suction with an increased wind velocity/pressure. This produces the paper under transportation to flutter easily.

In the conventional configuration, the paper 110 is guided by the carrying rollers 112 and 116 disposed at the front and rear sides of the flash fixation unit, which produces a reduced tension of the paper 110 between the carrying rollers 112 and 116. Therefore, when increased suction power is applied, the paper is apt to float up to a large extent, resulting in an unfixed image on the paper 110 possibly contacting to the upper surface of the transportation path (glass plate 103). This produces the fixed image on the paper 110 to adhere to a suction duct of the suction mechanism 104, causing a trouble in the print result such as dimmed print.

Furthermore, in order to increase the suction power, a large-scale suction blower (having large suction capability) is required. This brings about not only a larger blower in size but also increase of noise and cost. Another method for preventing the paper from fluttering during transportation is to suck the gas from the opposite side of the suction mechanism 104 across the paper 110. However, it is difficult to conduct air balancing, which makes it difficult to prevent from contacting to the paper 110. Moreover, the suction from the opposite side requires more suction capability than inherently required for the gas collection in the suction blower. This results in requiring a larger suction blower in size.

In a yet another method, it may be possible to increase the suction area while maintaining necessary suction time within a limit. This method also brings about larger suction mechanism 104 as well as larger suction blower, resulting in the unit substantially larger in size with increased noise and cost.

SUMMARY OF THE INVENTION

Accordingly, it is an object of the present invention to provide a flash fixation apparatus for improving efficiency in collecting gas (evaporated gas) produced from toner at the time of flash fixation while preventing a medium trouble in printing and a printer using the flash fixation apparatus.

It is another object of the present invention to provide a flash fixation apparatus for improving efficiency in collecting gas produced from toner at the time of flash fixation without applying large suction power in high-speed printing, and a printer using the flash fixation apparatus.

It is still another object of the present invention to provide a flash fixation apparatus for improving gas collection efficiency of the gas produced from toner at the time of flash fixation without need of a large unit in size even for high-speed printing, and a printer using the flash fixation apparatus.

Further, it is still another object of the present invention to provide a flash fixation apparatus for improving gas collection efficiency of the gas produced from toner during flash fixation while preventing a print medium under transportation from flattering, and a printer using the flash fixation apparatus.

To attain the above-mentioned objects, according to the present invention, a flash fixation apparatus for fixing a toner image on a medium under transportation by means of flash light includes; a flash fixation unit for emitting the flash light; a gas collector being disposed at the downstream side toward the medium transportation direction of the flash fixation unit for collecting vapor gas produced in flash fixation; and a guide being disposed between the flash fixation unit and the gas collector for altering the medium transportation direction. The aforementioned gas collector has a gas suction face disposed along the altered transportation direction.

Further, according to the present invention, a printer for forming a toner image onto a medium being transported at a predetermined transportation velocity includes; an image forming unit for forming a toner image onto the medium; and a flash fixation unit for fixing the toner image generated on the medium by means of flashlight. The flash fixation unit further includes, a flash fixation device for emitting the flash light; a gas collector being disposed at the downstream side toward the medium transportation direction of the flash fixation device for collecting vapor gas produced in flash fixation; and a guide being disposed between the flash fixation device and the gas collector for altering the medium transportation direction. Here, the gas collector has a gas suction face disposed along the altered transportation direction.

In the flash fixation apparatus of the present invention, vapor gas produced in flash fixation flows toward the medium transportation direction. Considering this, a guide for altering the medium transportation direction is provided at the entry of the gas collector. Further a gas suction face is provided so as to receive the vapor gas which flows along the altered medium transportation direction. Thus, the vapor gas flows into the gas suction face naturally, bringing about improved gas collection efficiency.

As a result, higher printing speed can be attained. In addition, it becomes possible, to collect vapor gas without increasing either suction power or suction area of the gas collector even when the vapor gas amount is increased, as well as to avoid medium flattering which may possibly occur at the time of medium transportation. Thus a miniaturized and low-cost flash fixation unit can be obtained.

According to the present invention, preferably the aforementioned gas suction face is directed to the vapor gas flow direction.

Further, according to the present invention, preferably a second guide for guiding the medium is provided on the exit (downstream) side of the gas collector. This enables to sustain medium tension at the gas collector so that medium flattering can be avoided even when high-speed printing is carried out, as well as enabling low-tension medium for use.

Still further, according to the present invention, preferably an angle of the gas suction face is maintained no more than 90 degrees against the medium transportation direction. This enables to guide the vapor gas flow effectively toward the gas suction face.

Further, the flash fixation apparatus in accordance with the present invention includes; a flash fixation unit for emitting the flash light; a gas suction unit being disposed at the downstream side toward the medium transportation direction of the flash fixation unit for sucking vapor gas produced in flash fixation; and a gas blast mechanism for blasting gas to the medium being disposed at the downstream side of the gas suction unit.

According to the present invention, the printer for forming a toner image onto a medium being transported at a predetermined transportation velocity includes an image forming unit for forming a toner image onto the medium; and a flash fixation unit for fixing the toner image generated on the medium by means of flashlight. The flash fixation unit further includes; a flash fixation device for emitting the flash light; a gas suction unit being disposed at the downstream side toward the medium transportation direction of the flash fixation device for sucking vapor gas produced in flash fixation; and a gas blast mechanism for blasting gas to the medium being disposed at the downstream side of the gas suction portion.

In this embodiment of the present invention, there are provided a gas collector for collecting vapor gas which flows in this transportation direction and a gas blast portion at the rear stage of the gas collector in the flash fixing device, considering that vapor gas produced in flash fixation flows toward the medium transportation direction. This constitutes an air curtain at the exit (downstream side) of the gas collector, preventing the vapor gas from leaking out of the gas collector and thus improving gas collection efficiency.

As a result, higher medium printing speed can be attained. In addition, it becomes possible to collect vapor gas without increasing either suction power or suction area of the gas collector even when the vapor gas amount is increased, as well as to prevent the medium under transportation from flattering. Thus a miniaturized and low-cost flash fixation unit can be obtained.

Also, according to the present invention, preferably the capacity of the gas blast mechanism is set larger than the capacity of the gas suction portion, which improves gas collection efficiency.

Further, according to the present invention, preferably a level difference is provided between the outlet of the blast mechanism and the intake of the gas suction portion, which improves gas collection efficiency.

Still further, according to the present invention, preferably there is further provided a circulation mechanism for filtering the suction gas being sucked in the gas suction portion to circulate to the blast mechanism. This reduces an exhaust gas to be output externally, which contributes to maintain the environment as well as obtains improved gas collection efficiency.

Further scopes and features of the present invention will become more apparent by the following description of the embodiments with the accompanied drawings.

DETAILED DESCRIPTION OF THE PREFERRED EMBODIMENTS

The preferred embodiment of the present invention is described hereinafter in order of a printer, a flash fixation unit, another flash fixation unit, and the other embodiments referring to the charts and drawings, wherein like numerals or symbols refer to like parts.

Printer

Figure 1:
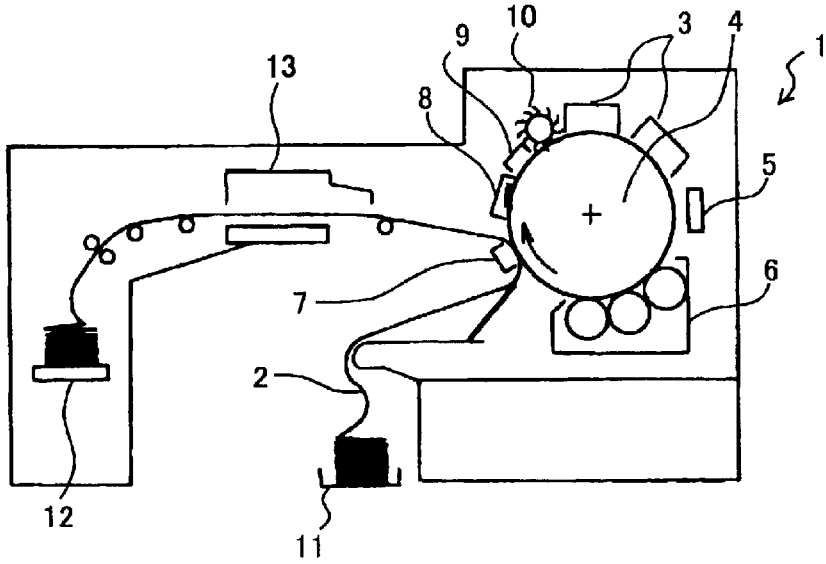
FIG. 1 shows a configuration diagram of a printer according to one embodiment of the present invention.

FIG. 1 shows a configuration diagram of one embodiment of a printer according to the present invention. In this figure, there is shown the configuration of an electrophotographic printer 1 which handles continuous paper as a printer concerning one embodiment of the present invention.

Continuous paper 2 loaded on a paper hopper 11 has tractor holes and is continuously carried by a tractor feed system. The continuous paper 2 is then accommodated into a stacker 12 via an image transfer unit 7 and a flash fixation unit 13. A photosensitive drum 4 rotating clockwise is uniformly charged by a charging unit 3. Thereafter an image is exposed by an optical system 5. Thus an electrostatic latent image is produced on the photosensitive drum 4 corresponding to the image. This electrostatic latent image produced on the photosensitive drum 4 is developed by a development unit 6. Thereafter a toner image on the photosensitive drum 4 is transferred onto the continuous paper 2 by image transfer unit 7.

After this image transfer, electric charges on the photosensitive drum 4 are eliminated by a charge eliminator 9. The residual toner is cleaned up by a cleaning blade 8 and a cleaning brush 10. The continuous paper 2 on which the toner image is transferred is flash-fixed by flash fixation unit 13 and then is accommodated into the stacker 12. A non-illustrated flash control unit controls light emission (emission frequency) of a flash lamp provided in the flash fixation unit 13 according to transportation velocity of the continuous paper 2.

Namely, first a toner image is formed on the photosensitive drum 4. The toner image is transferred to the continuous paper 2 to produce the toner image onto the continuous paper 2. The flash fixation unit 13 irradiates a flashlight onto the continuous paper 2. The toner of toner image produced on the continuous paper 2 is abruptly heated by flash light energy to fuse the toner to fix. The toner is formed of organic compound such as polyester. Through this abrupt heating, a sublimate (organic gas) is produced from the toner.

The flash fixation unit 13 is suitable for high-speed printing because of the non-contact toner fixation which enables to avoid additional load for carrying paper, resulting in easy implementation of high-speed paper transportation.

Flash Fixation Unit

Figure 2:
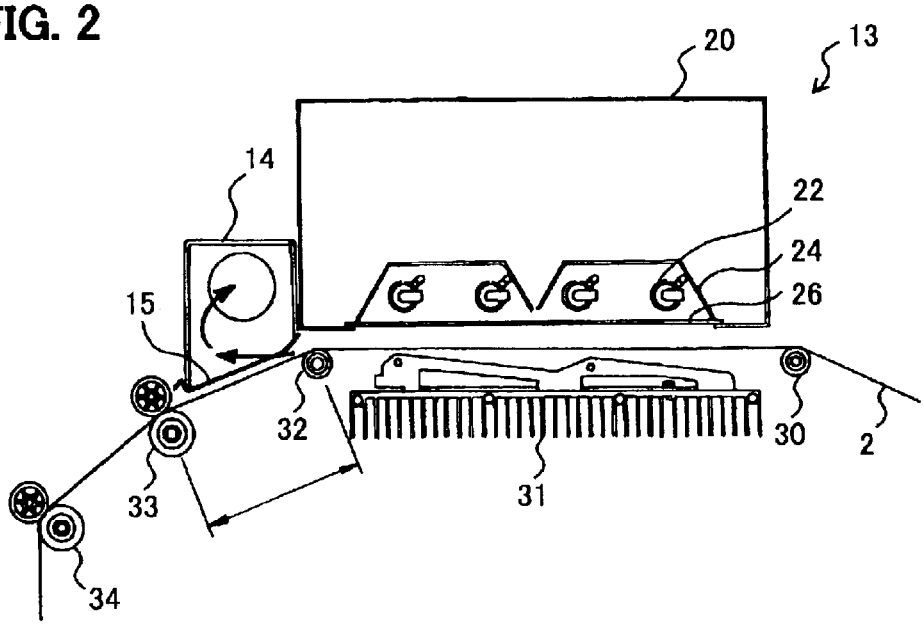
FIG. 2 shows a cross-sectional view of a flash fixation unit according to a first embodiment shown in FIG. 1.
Figure 3:
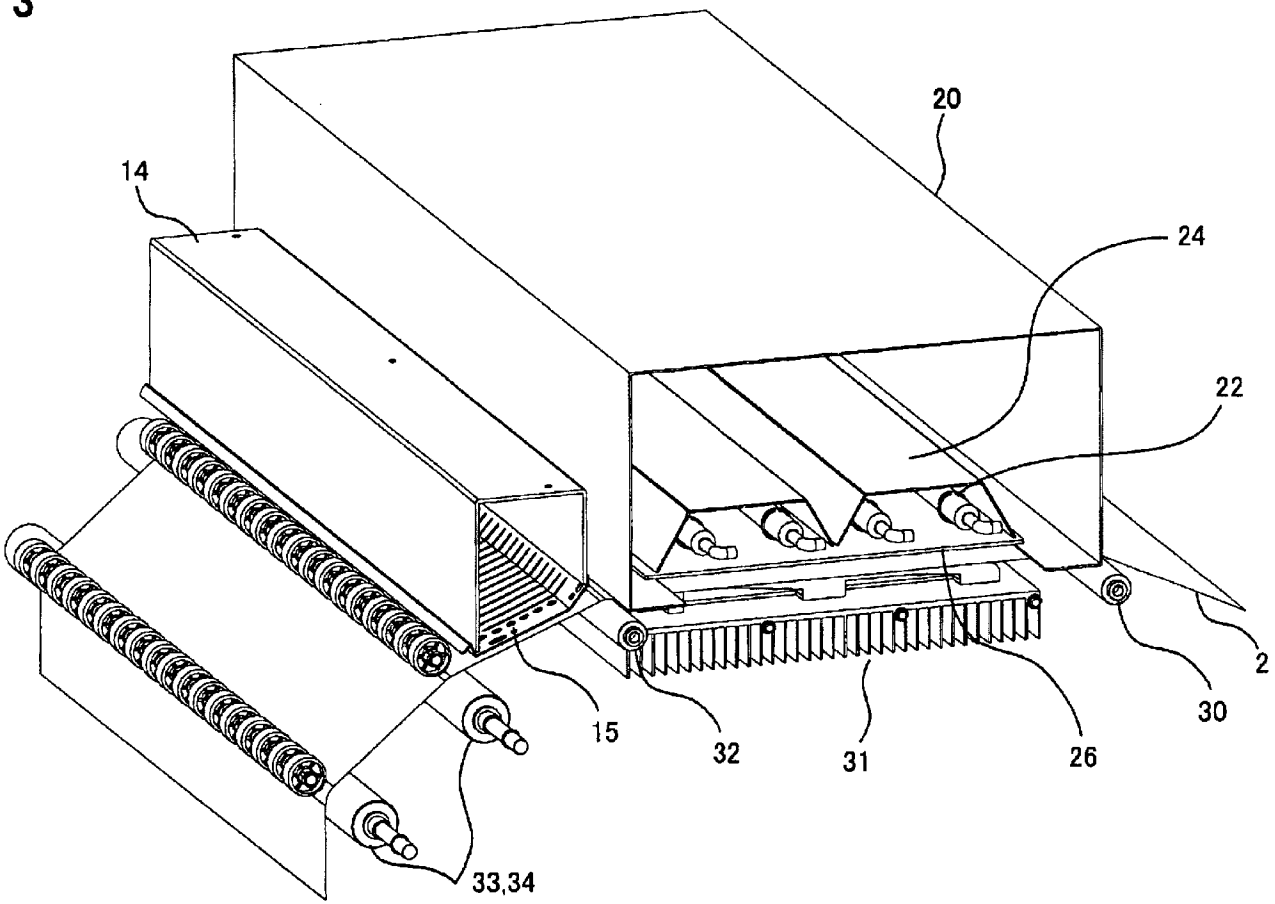
FIG. 3 shows a perspective view of the flash fixation unit shown in FIG. 2.
Figure 4:
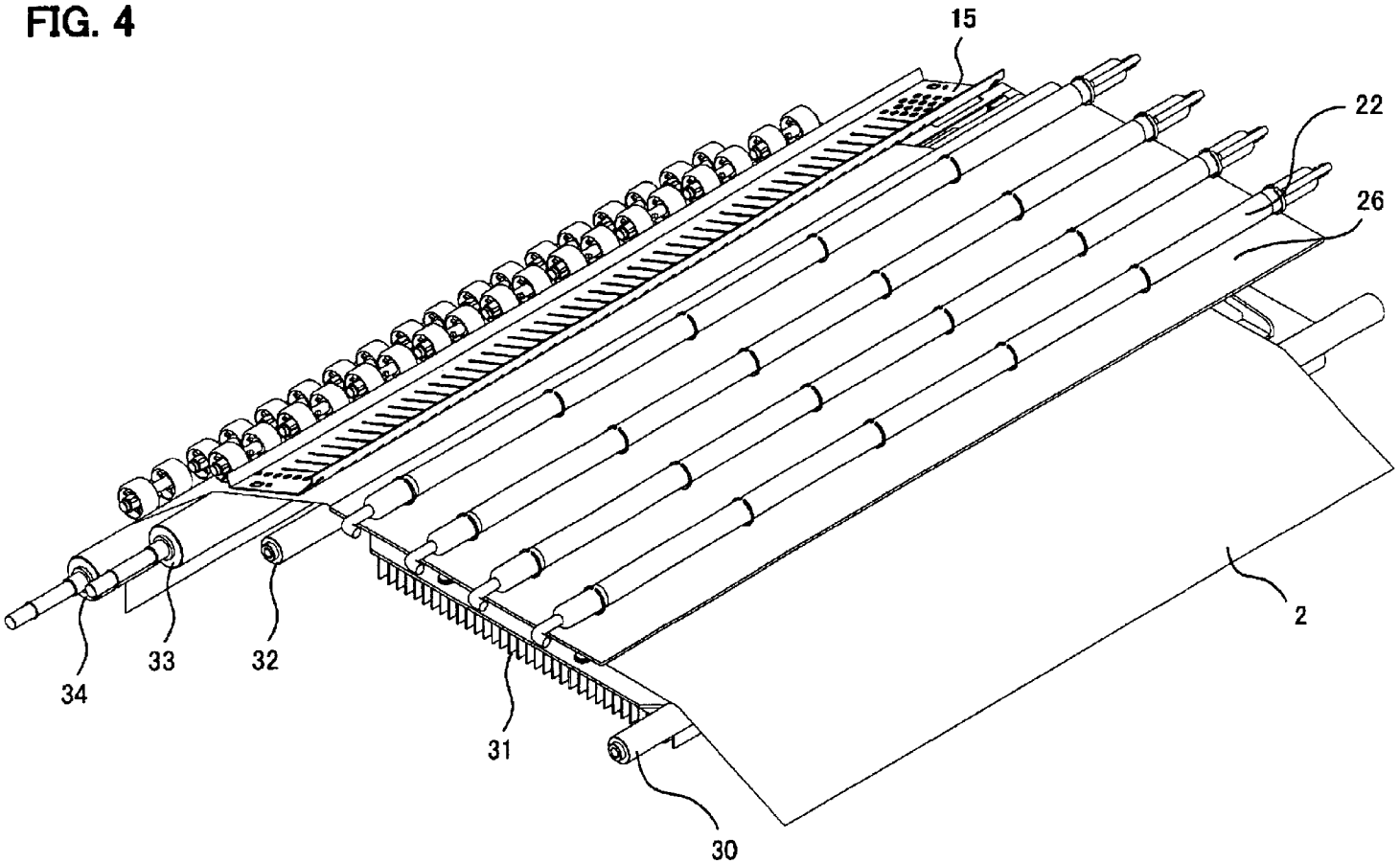
FIG. 4 shows a perspective view of the main portion of the flash fixation unit shown in FIG. 2.

FIG. 2 shows a cross-sectional view of a first embodiment of flash fixation unit 13 according to the present invention. FIG. 3 shows a perspective view thereof. Also, FIG. 4 shows a perspective view of the main portion of flash fixation unit 3.

As shown in FIGS. 2 and 3, the flash fixation unit 13 includes a flash lamp 22 and a reflection plate 24 inside a lamp house 20. The paper 2 side of the lamp house 20 is covered with a glass plate 26 to isolate the inside of the lamp house 20 from outside. Here, four flash lamps 22 and two reflection plates 24 are employed so as to widen the irradiation area produced by flash light at one time, as well as to produce a unified light energy distribution throughout the irradiation area. However, either the number of flash lamps or the number of reflection plates is not limited to the above description. An arbitrary number can be adopted as required.

As the flash lamp 22, there is employed flash lamp of a cylinder-shaped ozoneless silica glass having a predetermined arc length and sealed Xe gas. Also, the glass plate (light transparent plate) 26 is provided between the flash lamp 22 and the continuous paper 2 formed of glass. For this glass plate 26, preferably a silica glass contained water produced by the VAD method is used. This silica glass contained water produced by the VAD method has an improved transmittance in infrared region (having a wavelength in the vicinity of 200 nm), contributing to improve the fixation ratio against a toner having an absorption wavelength in this region.

The reflection plate 24 is disposed to cover the flash lamp 22. Preferably the inside plane of the case thereof is evaporated with aluminum and thereafter reflection intensification process is conducted. By means of the reflection plate 24, the light emission energy distribution can be formed into the trapezoid shape.

Because the inside of the lamp house 20 is isolated from outside, the flash lamp 22 can be prevented from being heated by air-cooling the inside with cooled air. Thus it becomes possible to increase light emission frequency of the flash lamp 22 to enable high-speed printing.

A block 31 is provided oppositely the lamp house 20 across the paper 2. The block 31 prevents the flashlight emitted from flash lamp 22 from leaking outside the fixation unit. This enables to prevent performance degradation of other units (such as photosensitive drum 4) which possibly occurs caused by intense flash light, as well as to avoid influence against a human body such as an operator who is situated in the vicinity of printer 1. The block 31 is provided with a cooling fin to protect from being heated by the flashlight.

Suction mechanism 14 is disposed on the exit (downstream) side of the lamp house 20 and includes a suction duct face 15. The suction duct 14 is connected to a non-illustrated suction blower to suck gas through the suction duct face 15.

A guide roller 30 being provided at the entrance of the lamp house (main body of the flash fixation unit) 20 guides the paper 2 produced a toner image thereupon to lead to the position between the flash lamp 22 and the block 31. A guide roller 32 is provided at the exit (downstream) of the lamp house 20 to alter the transportation direction of the paper 2. The suction duct face 15 is disposed along this altered transportation direction.

Namely, as shown by the arrow in FIG. 2, the gas produced by flash fixation flows by inertia to the paper transportation direction. Therefore, by directing the suction duct face 15 toward this gas inertia direction, gas collection efficiency of the suction mechanism 14 can be improved.

In this case, at the front of the flash lamp 22 in the lamp house 20, it is important that the paper 2 shall be maintained at a certain distance from the glass plate 26, keeping at a uniform distance throughout the flash exposure area so as to obtain desired flash fixation performance. In order to direct the suction duct face 15 to the inertia gas flow direction, the guide 32 is disposed between the lamp house 20 and the suction duct 14 at the rear side of the paper fixation face so as to bend paper 2.

The paper 2 contacts to this guide 32 to alter the paper transportation direction (for example, to alter from a horizontal direction to an inclined direction). The suction duct face 15 is disposed along this altered paper transportation direction. The suction width of this suction duct face 15 as well as the distance to the paper 2 is determined considering matching with both a paper transportation velocity and suction blower performance.

With this configuration, gas (evaporated gas) generated on the paper 2 face flows into the suction duct face 15, resulting in producing high efficient gas collection. Accordingly, gas can be sucked from the suction duct face 15 having narrower width, thus enabling to miniaturize the gas collector. In addition, it is not necessary to increase suction power of the suction blower, and therefore the blower can also be miniaturized.

With this alteration of paper transportation angle, it is necessary for the suction duct face 15 to direct to the inertia direction of the gas flow. The alteration degree $\theta$ is required to be 0 degree $<\theta<90$ degrees against the horizontal flash fixation face. Considering the layouts of a stacker 11 and a hopper 12, thirty (30) degrees ±10 degrees is desirable.

Further, a drive roller (or guide) 33 is disposed exactly after the suction duct 14. Thus the guides for paper 2 are positioned before and after the suction duct 14. It is possible to shorten the distance between the guides 32 and 33 disposed before and after the suction duct 14. This enables the paper 2 to resist tightly against suction power of the suction duct 14, enabling to prevent the paper 2 from contacting to the duct face 15.

Accordingly, paper tension can be maintained in the suction duct 14, and paper flattering can be prevented without providing a suction mechanism on the paper rear side as was required in the conventional art. This contributes to the simplification of the device structure. Moreover, this can prevent the rear face of the paper from contacting to the suction mechanism on the rear face which caused a problem at the time of double-sided printing.

Furthermore, it becomes hard to broke tractor hole in the tractor portion at the time of paper feeding, enabling to use thinner paper. Also, even when a pre-printed paper having small surface friction resistance, which is difficult to pull by a scuffing roller 34, paper can be conveyed without occurrence of trouble.

Other Flash Fixation Unit

Figure 5:
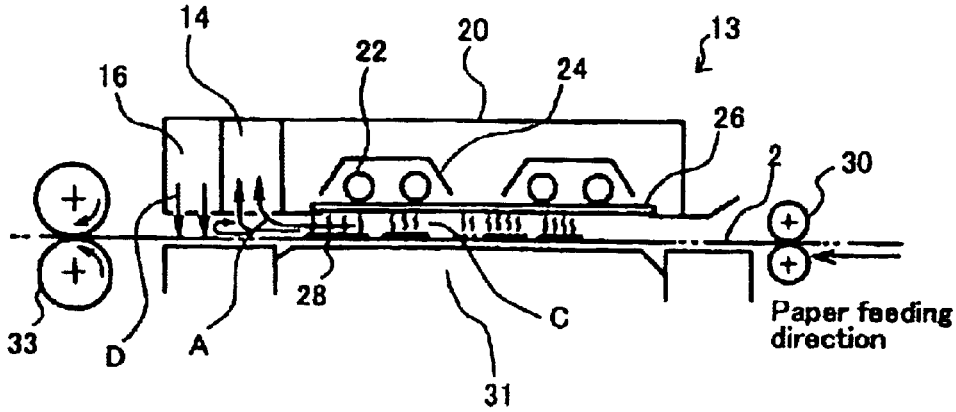
FIG. 5 shows a cross-sectional view of a second embodiment of the flash fixation unit according to the present invention.
Figure 6:
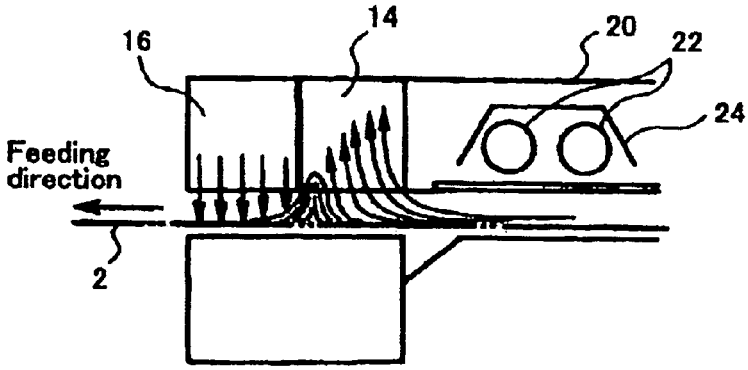
FIG. 6 shows an operation explanation diagram of the configuration shown in FIG. 5.

FIG. 5 shows a cross-sectional view of a second embodiment of the flash fixation unit in accordance with the present invention. FIG. 6 shows an operation explanation diagram thereof.

In FIGS. 5 and 6, like parts having been illustrated in FIG. 2 is referred to by like symbols. Namely, the flash fixation unit 13 accommodates the flash lamp 22 and the reflection plate 24 in the lamp house 20. The paper 2 side of the lamp house 20 is covered with a glass plate 26 to isolate the inside of the lamp house 20 from outside. Here, four flash lamps 22 and two reflection plates 24 are employed so as to widen the irradiation area produced by flashlight at a time and to unify light energy distribution throughout the irradiation area. However, the number of flash lamps or reflection plates is not limited to the above description. An arbitrary number can be adopted as the need demands.

The flash lamp 22 is structured by a cylinder-shaped ozoneless silica glass having a predetermined arc length, in which Xe gas is sealed. Also, the glass plate (light transparent plate) 26 is disposed to be sandwiched by the flash lamp 22 and the continuous paper 2. The reflection plate 24 is disposed to cover the flash lamp 22. Preferably the inside plane of the case thereof is evaporated with aluminum and thereafter reflection intensification process is conducted. By means of this reflection plate 24, the light emission energy distribution can be formed into the trapezoid shape.

Because the inside of the lamp house 20 is isolated from outside, the flash lamp 22 can be prevented from being heated by internally air-cooling with cooled air. Thus it becomes possible to increase light emission frequency of the flash lamp 22 to enable high-speed printing.

A block 31 is provided oppositely to the lamp house 20 across the paper 2. The block 31 prevents the flashlight emitted from the flash lamp 22 from leaking outside the flash fixation unit 13. A suction mechanism 14 is disposed on the exit (downstream) side of the lamp house 20 and has a suction mechanism face. The suction mechanism 14 is connected to a non-illustrated suction blower to suck gas as shown by an arrow A in FIG. 5 from the suction mechanism face.

A guide roller 30 provided at the entrance of the lamp house (main body of the flash fixation unit) 20 guides the paper 2 on which a toner image 28 is formed to the position between the flash lamp 22 and the block 31. A transportation roller 33 conveys the paper 2 at the exit of the flash fixation unit.

In order to prevent gas C having been produced by the fixation from leaking to the transportation downstream side, a blast mechanism 16 for blasting gas toward the paper 2 is disposed at the downstream side of the suction mechanism 14. The blast mechanism 16 plays a roll of an air seal by blasting air as shown by an arrow D onto the paper face. Thus leakage of gas C toward the downstream side of the transportation can be avoided.

Further, by configuring the blast mechanism 16 so as to blast air with a variable velocity and thus by increasing the intensity of air onto the paper 2 in case of either high density printing or high speed printing, air-sealing capability can be increased.

Accordingly, flattering of the paper 2 can be avoided by providing the air suction mechanism 14 for collecting gas (evaporated gas) C produced from the toner 28 at flash-fixation, as well as the blast mechanism 16 at the rear thereof for blasting air. Moreover, blasting air onto the paper functions as air sealing, which can improve gas collection efficiency by the suction mechanism 14.

Figure 7:
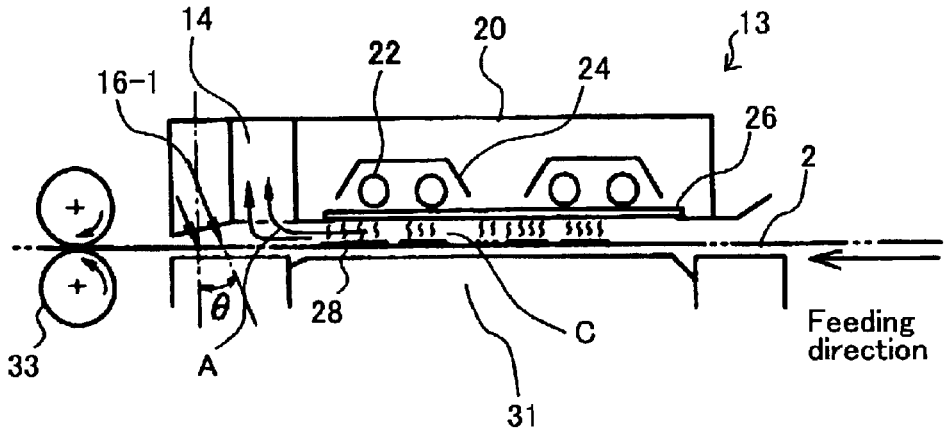
FIG. 7 shows a cross-sectional view of a third embodiment of the flash fixation unit according to the present invention.
Figure 8:
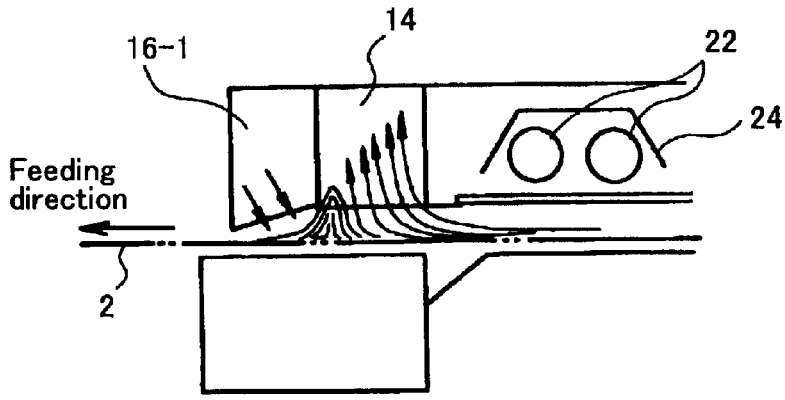
FIG. 8 shows an operation diagram of the configuration shown in FIG. 7.

FIG. 7 shows a cross-sectional view of a third embodiment of the flash fixation unit in accordance with the present invention. FIG. 8 shows an operation explanation diagram thereof.

In FIGS. 7 and 8, like parts shown in FIG. 5 are referred to by like symbols. In this example, air is blasted with an angle against the paper face. More specifically, a blast mechanism 16-1 is provided at the downstream of the suction mechanism 14 with an angle of θ against the paper face.

As shown in FIG. 8, blasted air has an angle so as to push back gas C flowing from the suction mechanism 14 actively toward the duct face of the suction mechanism. Thus gas collection efficiency of the suction mechanism 14 is improved as well as preventing paper from flattering. To blast air in an oblique way, the blasting outlet is provided obliquely.

Figure 9:
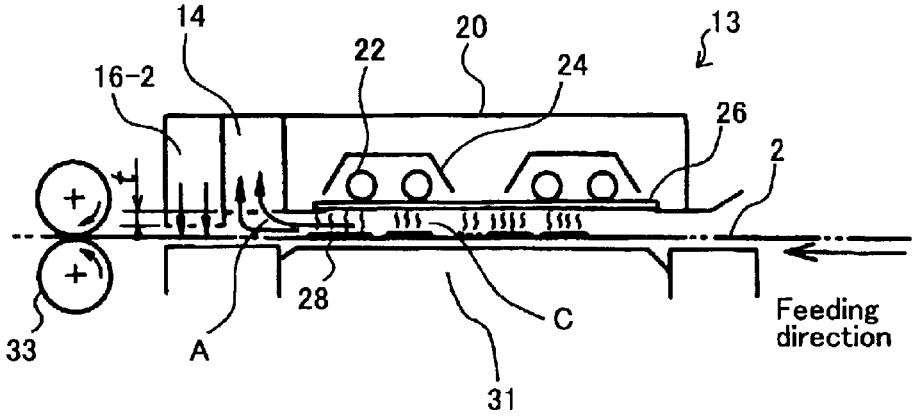
FIG. 9 shows a cross-sectional view of a fourth embodiment of the flash fixation unit according to the present invention.

FIG. 9 shows a cross-sectional view of a fourth embodiment of the flash fixation unit in accordance with the present invention. In FIG. 9, like parts shown in FIG. 5 are referred to by like symbols. In this example, there is provided a level difference 't' in the positional relation between an outlet of the blast mechanism 16-2 and an intake of the suction mechanism 14. Because the outlet of the blast mechanism 16-2 is positioned nearer to paper 2 than the intake of the suction mechanism 14, the seal effect is generated at the portion of level difference 't', enabling to improve collection ratio of gas (evaporated gas) C.

Figure 10:
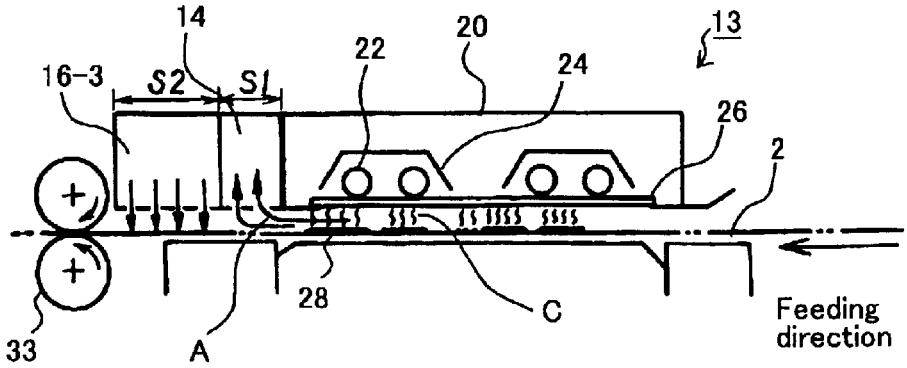
FIG. 10 shows a cross-sectional view of a fifth embodiment of the flash fixation unit according to the present invention.
Figure 11:
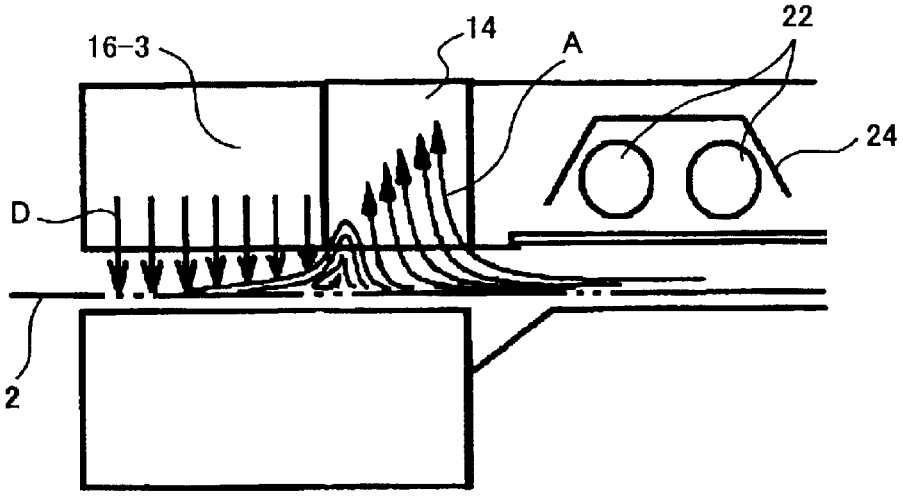
FIG. 11 shows an operation diagram of the configuration shown in FIG. 10.

FIG. 10 shows a cross-sectional view of a fifth embodiment of the flash fixation unit in accordance with the present invention. FIG. 11 shows a diagram illustrating evaporated gas flow for explaining the operation thereof. In FIGS. 10 and 11, like parts shown in FIG. 5 are referred to by like symbols. In this embodiment, the capacity of the blast mechanism 16-3 and the capacity of the suction mechanism 14 are different. Namely, the blast width S2 of the blast mechanism 16-3 is set greater than the suction width S1 of the suction mechanism 14. As shown in FIG. 11, evaporated gas flow with capacity difference is sealed. Namely, even when evaporated gas has large viscosity, greater sealing effect can be obtained by increasing the capacity of the blast mechanism 16-3.

Figure 12:
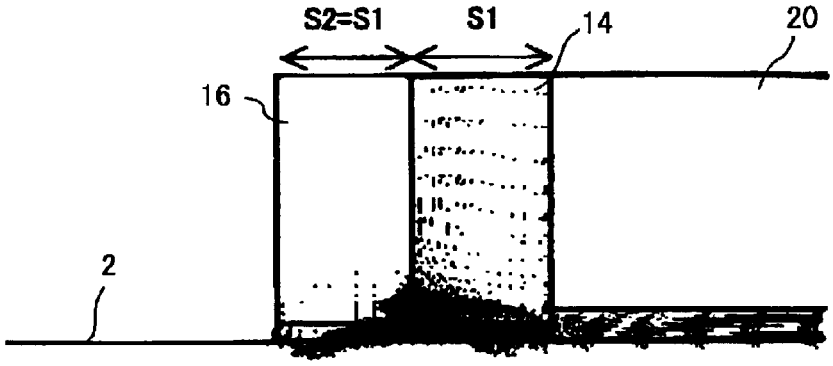
FIG. 12 shows an explanation diagram illustrating a first simulation result of evaporated gas flow produced by a blast mechanism according to the present invention.
Figure 13:
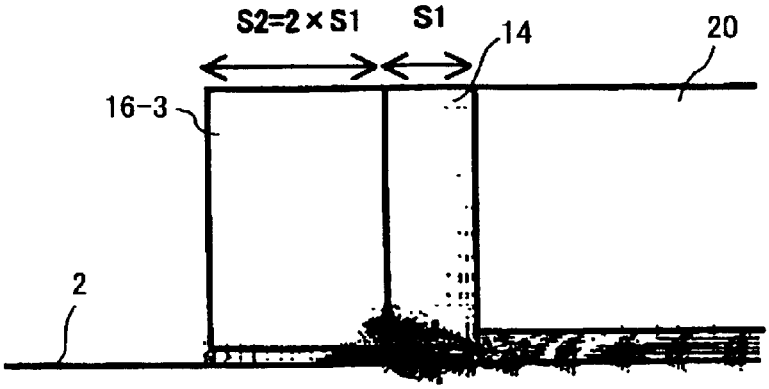
FIG. 13 shows an explanation diagram illustrating a second simulation result of evaporated gas flow produced by a blast mechanism according to the present invention.
Figure 14:
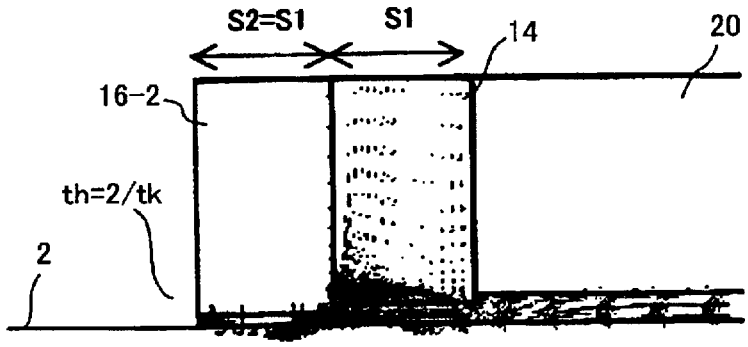
FIG. 14 shows an explanation diagram illustrating a third simulation result of evaporated gas flow produced by a blast mechanism according to the present invention.
Figure 15:
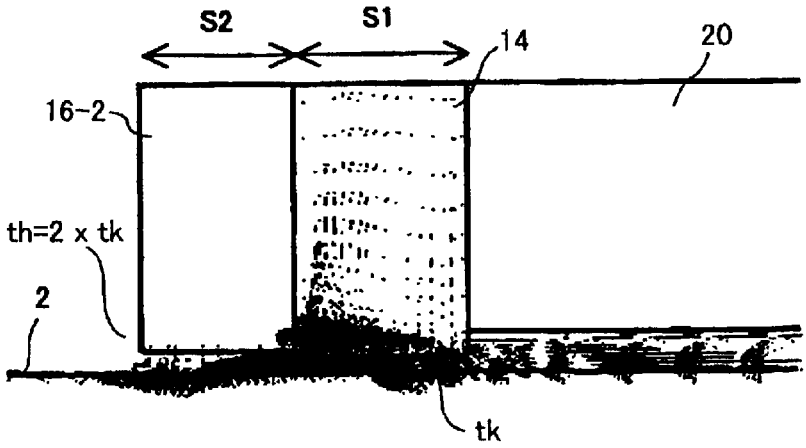
FIG. 15 shows an explanation diagram illustrating a fourth simulation result of evaporated gas flow produced by a blast mechanism according to the present invention.
Figure 16:
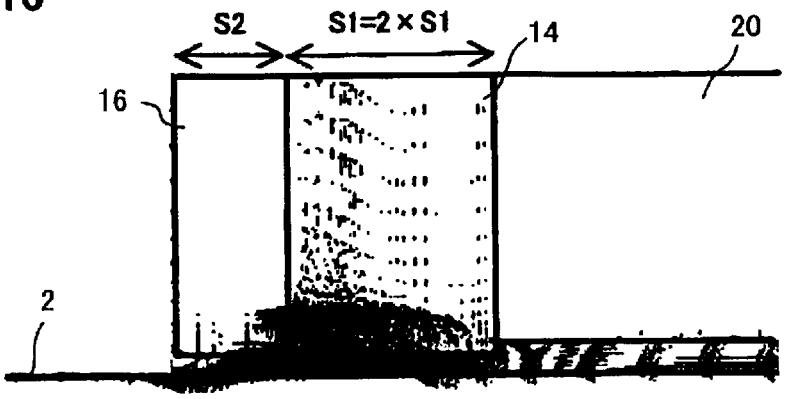
FIG. 16 shows an explanation diagram illustrating a fifth simulation result of evaporated gas flow produced by a blast mechanism according to the present invention.

FIGS. 12 to 16 show diagrams of simulation experiment results on evaporated gas flow in the flash fixation unit. FIG. 12 shows the case of blast width S2 of the blast mechanism 16 being set identical to suction width S1 of the suction mechanism 14. FIG. 13 shows the case of blast width S2 of the blast mechanism 16 being set twice as large as suction width S1 of the suction mechanism 14. Also, FIG. 16 shows the case of blast width S2 of the blast mechanism 16 being set half as large as suction width S1 of the suction mechanism 14. Additionally, in FIGS. 14 and 15, the cases that distance 'th' between the blast mechanism 16 and the paper 2 as well as distance 'tk' between the suction mechanism 14 and the paper 2 is varied.

In FIGS. 12 to 16, each parameter in simulation denotes as follows:

S1: capacity (width) of the suction mechanism 14

S2: capacity (width) of the blast mechanism 16, 16-2, 16-3

Vs: paper transportation velocity

Vh: blast wind velocity

Vk: suction wind velocity th: transportation gap on blast mechanism face tk: transportation gap on suction mechanism face FIG. 12 represents a wind velocity distribution in the case of S1=S2, Vh=Vk, th=tk=4 mm, and Vs=1500 mm/sec. The gas produced by the flash fixation flows toward a paper transportation direction as a whole. Nevertheless, it is understood that the gas flow is blocked by the blast mechanism 16. In other words, the gas flowing in the downstream direction of transportation is blocked by the blast from the blast mechanism.

FIG. 13 represents the wind velocity distribution in the case of 2×S1=S2, Vh=Vk, th=tk=4 mm, and Vs=1500 mm/sec. By the effect of the blast mechanism 16-3, the gas flow is blocked. However, as compared to the case shown in FIG. 12, the gas becomes hard to flow in the downstream direction of transportation. Namely, because the capacity of the blast mechanism 16-3 (or the length in the downstream direction of transportation) has been increased, the evaporated gas becomes hard to flow in the downstream direction of transportation, and less leakage is produced even if the transportation velocity is increased.

FIG. 16 represents the wind velocity distribution in the case of S1=2×S2, Vh=Vk, th=tk=4 mm, and Vs=1500 mm/sec. Similar to the cases shown in FIGS. 12 and 13, a blocking effect of gas flow is exhibited. However, as compared to the case shown in FIG. 13, fewer margins are produced.

FIG. 14 represents the wind velocity distribution in the case of S1=S2, Vh=Vk, th=2 mm, tk=4 mm, and Vs=1500 mm/sec. By narrowing transportation gap (distance to the paper) 'th' of the blast mechanism 16-2, evaporated gas becomes hard to flow in the downstream direction of transportation.

FIG. 15 represents the wind velocity distribution in the case of S1=S2, Vh=Vk, th=4 mm, tk=2 mm, and Vs=1500 mm/sec. Though gas-blocking effect is exhibited, fewer margins are produced as compared to the case shown in FIG. 14.

Figure 17:
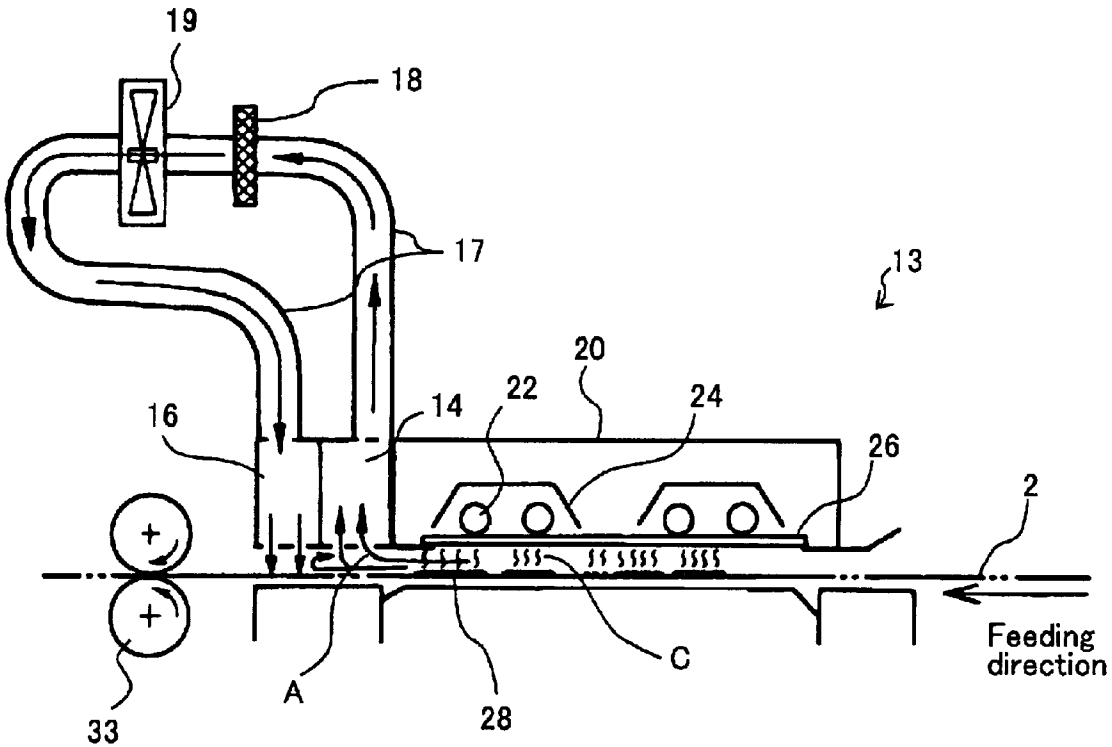
FIG. 17 shows a cross-sectional view of a sixth embodiment of the flash fixation unit according to the present invention.
Figure 18:
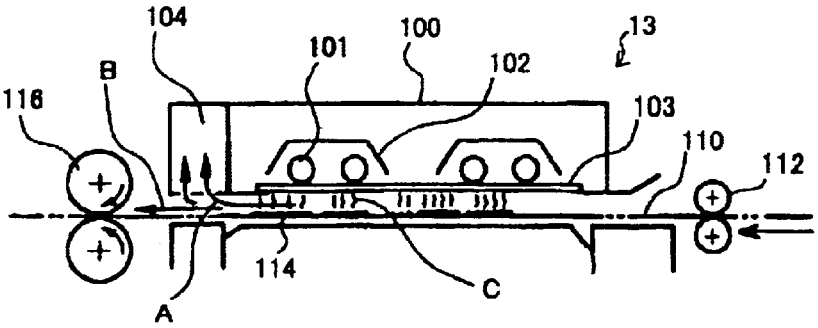
FIG. 18 Prior Art
FIG. 18 shows an explanation diagram of a conventional art.
Figure 19:
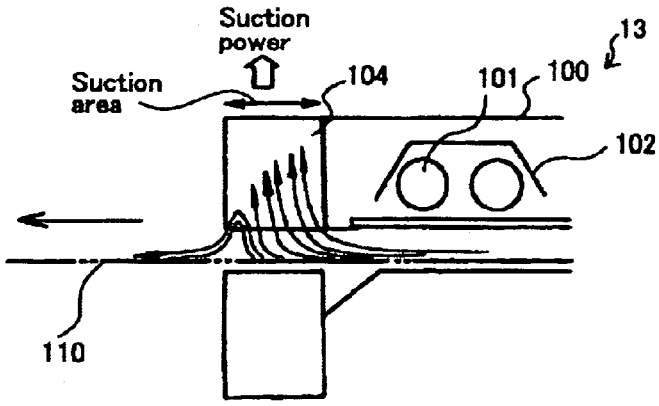
FIG. 19 Prior Art
FIG. 19 shows an explanation diagram of air collection operation according to the conventional art.

FIG. 17 shows a cross-sectional view of a sixth embodiment of the flash fixation unit in accordance with the present invention. In FIG. 17, like parts shown in FIG. 5 is referred to by like symbols. In this example, the suction mechanism 14 and the blast mechanism 16 is connected by an identical pipe line 17. In the pipe line (circulation hose) 17, a blower 19 and a degassing filter 18 are disposed at appropriate positions. The gas (evaporated gas) having been collected by the suction mechanism 14 is deodorized by degassing filter and reaches to the blast mechanism 16 through the blower 19.

In such a way, it becomes possible to decrease an exhaust gas amount flowing outward by circulating the sucked air. Conventionally, there has been a problem of polluting environment in high-speed printing because of impossibility in discharging completely scrubbed air outside of the unit. The aforementioned method can solve this problem.

Thus, according to the present invention, paper fluttering can be avoided by providing an air suction mechanism for collecting gas (evaporated gas) produced from toner at the time of fixation, as well as a blast mechanism being disposed at the rear of the suction mechanism for blasting air onto the paper. Blasting air onto the paper plays a role of air seal, enabling to increase collection rate by the suction mechanism. Further, an air amount being discharged outward from the unit can be reduced by circulating sucked air.

Other Embodiments

In the foregoing embodiments of the present invention, the flash fixation unit having four flash lamps has been illustrated. However, the method can also be applied to a flash fixation unit having a single flash lamp or more. Further, though the foregoing description is based on the electrophotographic printer, the method is also applicable to any printer printed by other printing schemes. Still further, though continuous paper is used in the foregoing description, other cut media such as cut form can be used. In addition, the method can be applied for not only paper medium but also other media such as film.

To summarize, the present invention produces the following effects:

In a flash fixation unit, considering that vapor gas produced by flash fixation flows in the direction of medium transportation, a gas suction face is provided in a gas collector for receiving the vapor gas which flows in this medium transportation direction. Otherwise, a gas blast portion is provided at the rear stage of the gas collector. By such means the vapor gas flows in a natural manner onto the gas suction face, bringing about increased gas collection efficiency.

As a result, higher printing speed can be attained. In addition, it becomes possible to collect vapor gas without increasing either suction power or suction area of the gas collector even when the vapor gas amount is increased, as well as to avoid medium flattering which may possibly occur at the time of medium transportation. Thus a miniaturized and low-cost flash fixation unit can be obtained.

The foregoing description of the embodiments is not intended to limit the invention to the particular details of the examples illustrated. Any suitable modification and equivalents may be resorted to the scope of the invention. All features and advantages of the invention which fall within the scope of the invention are covered by the appended claims.

What is claimed is:

1. A flash fixation apparatus for fixing a toner image on a medium under transportation by means of flash light comprising:

a flash fixation unit for emitting said flashlight;

a gas collector for collecting vapor gas produced in flash fixation, being disposed at the downstream side toward said medium transportation direction of said flash fixation unit; and a guide for altering said medium transportation direction, being disposed between said flash fixation unit and said gas collector, wherein said gas collector having a gas suction face disposed along said altered transportation direction.

2. The flash fixation apparatus according to claim 1 wherein said gas suction face is directed to said vapor gas flow direction.

3. The flash fixation apparatus according to claim 2 wherein an angle of said gas suction face ranges within 90 degrees against said medium transportation direction.

4. The flash fixation apparatus according to claim 1 further comprising:

a second guide for guiding said medium being disposed on the exit side of said gas collector.

5. A flash fixation apparatus for fixing a toner image on a medium under transportation by means of flash light comprising:

a flash fixation unit for emitting said flashlight;

a gas suction unit for sucking vapor gas produced in flash fixation, being disposed at the downstream side toward said medium transportation direction of said flash fixation unit; and a gas blast mechanism for blasting gas to said medium, being disposed at the downstream side of said gas suction unit.

6. The flash fixation apparatus according to claim 5 wherein the capacity of said gas blast mechanism is set larger than the capacity of said gas suction unit.

7. The flash fixation apparatus according to claim 5 wherein a level difference is provided between the outlet of said blast mechanism and the intake of said gas suction unit.

8. The flash fixation apparatus according to claim 5 further comprising:

a circulation mechanism for filtering said suction gas being sucked in said gas suction unit and circulating to said blast mechanism.

9. A printer for forming a toner image onto a medium being transported at a predetermined transportation velocity comprising:

an image forming unit for forming a toner image onto said medium; and a flash fixation device for fixing said toner image formed on said medium by means of flashlight, wherein said flash fixation device comprising:

a flash fixation unit for emitting said flashlight;

a gas collector for collecting vapor gas produced in flash fixation, being disposed at the downstream side toward said medium transportation direction of said flash fixation unit; and a guide for altering said medium transportation direction, being disposed between said flash fixation unit and said gas collector, and wherein said gas collector has a gas suction face disposed along said altered transportation direction.

10. The printer according to claim 9 wherein said gas suction face is directed to said vapor gas flow direction.

11. The printer according to claim 10 wherein an angle of said gas suction face ranges within 90 degrees against said medium transportation direction.

12. The printer according to claim 9 further comprising:

a second guide for guiding said medium being disposed on the exit side of said gas collector.

13. A printer for forming a toner image onto a medium being transported at a predetermined transportation velocity comprising:

an image forming unit for forming a toner image onto said medium; and a flash fixation device for fixing said toner image generated on said medium by means of flashlight, wherein said flash fixation device comprising:

a flash fixation unit for emitting said flashlight;

a gas suction unit for sucking vapor gas produced in flash fixation, being disposed at the downstream side toward said medium transportation direction of said flash fixation unit; and a gas blast mechanism for sucking vapor gas produced in flash fixation, being disposed at the downstream side of said gas suction unit for blasting gas to said medium.

14. The printer according to claim 13 wherein the capacity of said gas blast mechanism is set larger than the capacity of said gas suction unit.

15. The printer according to claim 13 wherein a level difference is provided between the outlet of said blast mechanism and the intake of said gas suction unit.

16. The printer according to claim 13 further comprising:

a circulation mechanism for filtering said suction gas being sucked in said gas suction unit and circulating to said blast mechanism.

* * * * *